US008752620B2

(12) United States Patent
Zeller et al.

(10) Patent No.: US 8,752,620 B2
(45) Date of Patent: Jun. 17, 2014

(54) SYSTEMS AND METHODS FOR SINGLE-PHASE FLUID SAMPLING

(75) Inventors: Vincent Paul Zeller, Flower Mound, TX (US); Paul David Ringgenberg, Frisco, TX (US); Scott Luke Miller, Highland Village, TX (US); Cyrus Aspi Irani, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 443 days.

(21) Appl. No.: 13/111,316

(22) Filed: May 19, 2011

(65) Prior Publication Data

US 2012/0291566 A1 Nov. 22, 2012

(51) Int. Cl.

| | |
|---|---|
| ***E21B 27/00*** | (2006.01) |
| ***E21B 47/00*** | (2012.01) |
| ***E21B 49/08*** | (2006.01) |
| ***G01N 1/22*** | (2006.01) |

(52) U.S. Cl.
USPC ..... 166/162; 166/264; 73/152.28; 73/864

(58) Field of Classification Search
USPC ..... 73/152.18, 152.23, 152.24, 152.28, 73/152.46, 864; 166/162, 264
See application file for complete search history.

(56) References Cited

U.S. PATENT DOCUMENTS

| | | | | |
|---|---|---|---|---|
| 4,125,165 | A * | 11/1978 | Helmus | 166/323 |
| 7,258,167 | B2 | 8/2007 | Shammai et al. | |
| 7,596,995 | B2 | 10/2009 | Irani et al. | |
| 7,673,506 | B2 | 3/2010 | Irani et al. | |
| 7,762,130 | B2 | 7/2010 | Irani et al. | |
| 2007/0236215 | A1 | 10/2007 | Innes et al. | |
| 2009/0241657 | A1 | 10/2009 | Irani et al. | |
| 2009/0301184 | A1 * | 12/2009 | Irani et al. | 73/152.28 |
| 2010/0116493 | A1 * | 5/2010 | Irani et al. | 166/264 |

FOREIGN PATENT DOCUMENTS

| | | | |
|---|---|---|---|
| WO | 9314295 | 7/1993 | |
| WO | WO 9314295 A1 * | 7/1993 | E21B 49/08 |
| WO | 2012158381 | 11/2012 | |

OTHER PUBLICATIONS

International Patent Application No. PCT/US2012/036770, "International Search Report and Written Opinion Received", mailed Nov. 28, 2012, (11 pages).

* cited by examiner

*Primary Examiner* — Hezron E Williams
*Assistant Examiner* — Nathaniel Kolb
(74) *Attorney, Agent, or Firm* — Kilpatrick Townsend & Stockton LLP

(57) ABSTRACT

An assembly capable of being disposed in a subterranean bore for obtaining a fluid sample is described. The assembly can include an apparatus having a sample chamber and a housing encasing the sample chamber and providing a pressure source. The pressure source can be disposed of in an annulus defined by the sample chamber and the housing. The assembly can be attached to a slick line or wire line and conveyed into a wellbore.

20 Claims, 4 Drawing Sheets

SYSTEMS AND METHODS FOR SINGLE-PHASE FLUID SAMPLING

TECHNICAL FIELD OF INVENTION

The present invention relates generally to testing and evaluation of subterranean formation fluids and, in particular (but not necessarily exclusively) to, a single-phase fluid sampling apparatus for obtaining a fluid sample and maintaining the sample near reservoir pressure.

BACKGROUND

It is well known in the subterranean well drilling and completion art to perform tests on formations intersected by a wellbore. Such tests are typically performed to determine geological or other physical properties of the formation and fluids provided thereform. For example, parameters such as permeability, porosity, fluid resistivity, temperature, pressure, and bubble point may be determined. These and other characteristics of the formation and fluid may be determined by performing tests on the formation before the well is completed.

One type of testing procedure that is commonly performed is to obtain a fluid sample from the formation to, among other things, determine the composition of the formation fluids. In this procedure, it is important to obtain a sample of the formation fluid that is representative of the fluid as it exists in the downhole environment. In some typical sampling procedures, a sample of the fluid may be obtained by lowering a sampling tool having a sampling chamber into the wellbore on a conveyance such as a wireline, slickline, coiled tubing, jointed tubing or the like. When the sampling tool reaches the desired depth, one or more ports are opened to allow collection of the formation fluids. The ports may be actuated in variety of ways such as by electrical, hydraulic or mechanical methods. Once the ports are opened, formation fluids travel through the ports and a sample of the formation fluids is collected within the sampling chamber of the sampling tool. After the sample has been collected, the sampling tool may be withdrawn from the wellbore so that the formation fluid sample may be analyzed.

It has been found, however, that as the fluid sample is retrieved to the surface, the temperature of the fluid sample decreases causing shrinkage of the fluid sample and a reduction in the pressure of the fluid sample. Once such a process occurs, the resulting fluid sample may no longer be representative of the fluids present in the formation. Therefore, a need has arisen for an apparatus and method for obtaining a fluid sample from a formation without degradation of the sample during retrieval of the sampling tool from the wellbore. A need has also arisen for such an apparatus and method that are capable of being conveyed via a slickline, wireline, or coiled tubing.

SUMMARY

Certain embodiments described herein are directed to apparatuses, systems, and methods for obtaining a fluid sample in a subterranean well. The apparatuses, systems, and methods can be disposed in a bore of a subterranean formation.

In one aspect, an apparatus can include a sampler and a housing. The sampler can have a sample chamber configured for being selectively in fluid communication with an exterior of the sampler. The sample chamber can receive at least a portion of a fluid sample. The housing can be disposed exterior to the sampler. An annulus can be defined between at least part of the housing and at least part of the sampler. The annulus can include a compressible fluid.

In at least one embodiment, the apparatus can be capable of being disposed in a subterranean well using at least one of a slickline, wireline, or coiled tubing.

In at least one embodiment, the compressible fluid can be nitrogen.

In at least one embodiment, the annulus can be selectively in fluid communication with the sample chamber. In such embodiments, the compressible fluid can be operable to pressurize the fluid sample received in the sample chamber.

In at least one embodiment, the apparatus can include a manifold. The manifold can facilitate fluid communication between the sampling chamber and the annulus.

In at least one embodiment, the housing can encase at least a portion of the sample.

In at least one embodiment, the housing can extend longitudinally along the length of the sampler.

In at least one embodiment, the housing can be positioned generally coaxially with the sampler.

In at least one embodiment, the annulus can have a volume. The volume of the annulus can be sufficient to include a volume of the compressible fluid to pressurize the fluid sample received in the sample chamber.

In at least one embodiment, the apparatus further includes a trigger. The trigger can cause or initiate the apparatus to obtain the fluid sample.

In at least one embodiment, the apparatus further includes a trigger sleeve. The trigger sleeve can be disposed exterior to the trigger and provide protection to the trigger from an environment exterior to the trigger.

In another aspect, a method for obtaining a fluid sample in a subterranean well is provided. The method includes positioning a fluid sampler in the well by at least one of a slickline, wireline, or coiled tubing; obtaining a fluid sample in a sample chamber of the fluid sampler; and pressurizing the fluid sample using a pressure source disposed in an annulus. The annulus can be defined by a housing encasing the fluid sampler. The pressure source can be in fluid communication with the sample chamber.

In at least one embodiment, the annulus can be defined by an inner diameter of the housing and an outer diameter of the fluid sampler.

In at least one embodiment, the annulus can extend longitudinally along the length of the sampler.

In at least one embodiment, the pressure source can be a compressible fluid.

In at least one embodiment, the compressible fluid can be nitrogen.

In at least one embodiment, the method further includes retrieving the fluid sampler to the surface.

In yet another aspect, a system for obtaining a fluid sample in a subterranean well is provided. The system can be disposed with a least one of a slickline, wireline, or coiled tubing. The system includes a sampler, a housing, and a pressure source comprising a compressible fluid. The sampler can receive a sample of hydrocarbon fluid in a sample chamber. The housing can be disposed exterior to an outer diameter of the sampler. The pressure source can be disposed within an annulus defined by the outer diameter of the sampler and an inner diameter of the housing. The housing can be configured to provide a pressure seal between the annulus and an environment exterior to the housing. The sampler can be configured to be selectively in fluid communication with the pressure source such that the compressible fluid is operable to pressurize the sample of hydrocarbon fluid.

In at least one embodiment, the system can include a valving assembly configured to permit pressure from the pressure source to be applied to the sampler.

In at least one embodiment, the system can include a trigger configured to cause the sampler to obtain the hydrocarbon fluid.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
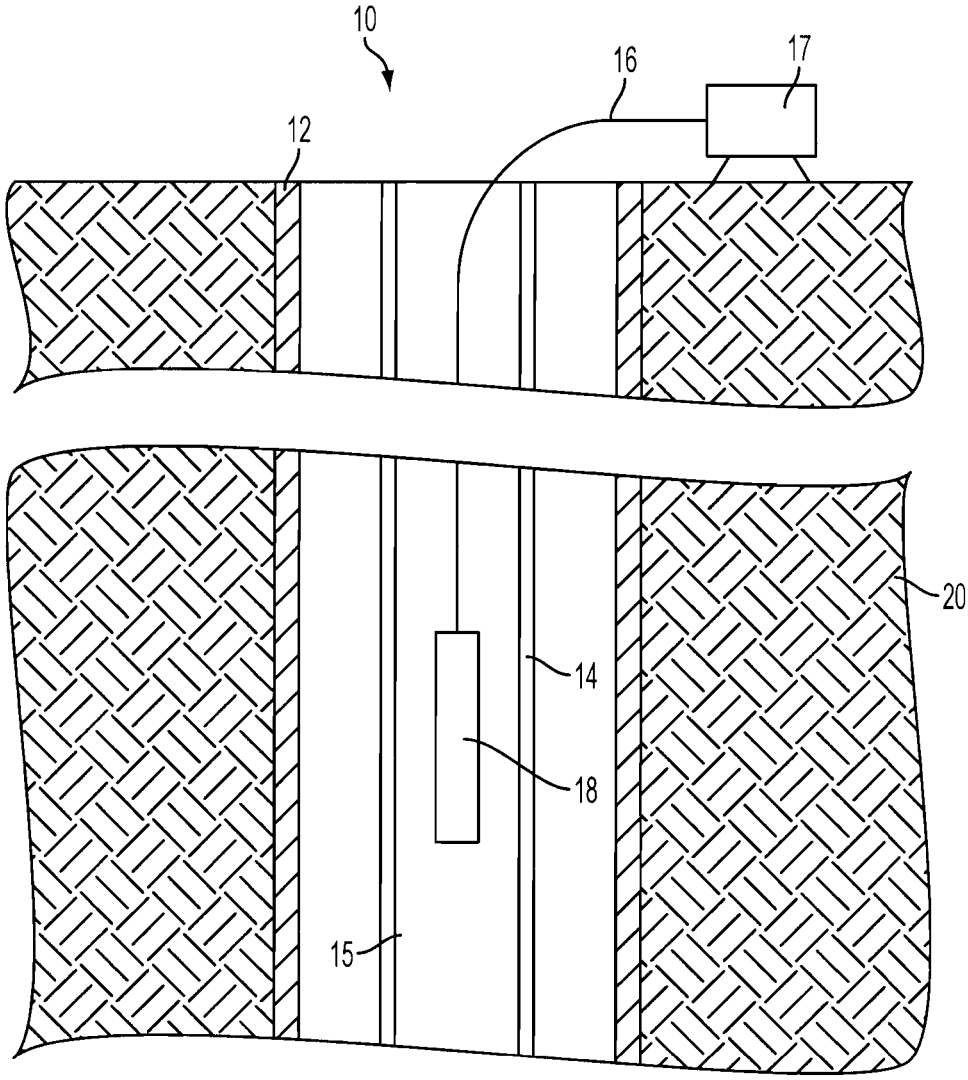
FIG. 1 is a schematic illustration of a well system having a fluid sampler apparatus according to one embodiment of the present invention.

Certain aspects and embodiments of the present invention relate to systems and assemblies that are capable of being disposed in a bore, such as a wellbore, in a subterranean formation for use in producing hydrocarbon fluids from the formation. In some embodiments, the assemblies and devices can include an apparatus for obtaining a fluid sample produced from a subterranean formation and maintaining the fluid sample near a reservoir pressure at which the fluid sample was obtained. In some embodiments, the assemblies and devices can be attached to a slickline, wireline, or coiled tubing and conveyed into a wellbore.

Described herein are devices and assemblies that comprise a sampler having a sample chamber and a housing encasing the sample chamber. Further, the devices and assemblies can comprise a pressure source. The pressure source can be disposed within an annulus defined by the inner diameter of the housing and the outer diameter of the sampler. In some embodiments, the housing and the sampler can be coaxial, have generally the same cylindrical axis, or have a generally concentric relationship such that the housing encases or surrounds the sampler.

Conventional sampling devices often rely on a separate, common nitrogen case to pressurize a fluid sample. In such devices, the nitrogen case is serially attached to the sampler device. It is desirable to minimize the number of devices, and in turn the resulting total length of devices conveyed downhole, when obtaining a sample from a formation. Some embodiments of the present invention described herein can increase the width of the fluid sampler system and minimize the length of the sampler system.

The housing can extend longitudinally along at least a portion of the sampler such that the annulus comprises a sufficient volume to house a pressure source for pressurizing the fluid sample. In some embodiments, the housing has a length greater than the sample chamber to provide a larger volume. The inner diameter of the housing may be modified to increase the volume of the annulus.

The pressure source can include a compressible fluid. In some embodiments, the compressible fluid is nitrogen. The compressed nitrogen can be disposed in the housing at between about 7,000 psi to about 15,000 psi. In other embodiments, other fluids or combination of fluids and/or other pressures both higher and lower can be used.

In some embodiments, the housing can provide a pressure seal to prevent the unintended release of the compressible fluid. For example, a Teflon® ring can be employed to provide a seal to prevent the unintended release of the compressible fluid from the apparatus.

Fluid sampler apparatuses according to some embodiments can be conveyed into the wellbore via a slickline, wireline, or coiled tubing.

A fluid sampler apparatus may include a trigger. In some embodiments, for example in a slickline application, a battery-powered or mechanical timer type device can be utilized to initiate the sampling process. An accelerometer may be employed that can initiate the sampling process once the apparatus has been stationary for a certain period of time. In other embodiments, for example in a wireline application, a signal can be sent via the wireline to turn on a motor or other like device to begin the sampling process by opening a valve.

At the position at which a sample is obtained within a wellbore, the sample is exposed to a certain pressure and environment conditions associated with the wellbore environment. According to certain embodiments of the present invention described herein, the nitrogen source, or other compressible fluid, can be used to pressurize the sample. In some embodiments, the nitrogen source can be located in a housing surrounding the sampler, rather than a separate, discrete component characteristic of conventional samplers.

The illustrative examples are given to introduce the reader to the general subject matter discussed herein and not intended to limit the scope of the disclosed concepts. The following sections describe various additional embodiments and examples with reference to the drawings in which like numerals indicate like elements and directional description are used to describe illustrative embodiments but, like the illustrative embodiments, should not be used to limit the present invention.

FIG. 1 shows a well system 10 comprising a fluid sampler apparatus 18 according to one embodiment. A tubular string 14 is positioned in a wellbore 12 extending through various earth strata 20. An internal flow passage 15 extends longitudinally through the tubular string 14.

The fluid sampler apparatus 18 is attached to a slickline 16. A spool 17 provides a structure upon which the slickline 16 can be wound and conveyed. In other embodiments, the fluid sampler apparatus 18 can be conveyed using a wireline, coiled tubing, downhole robot, or the like. Although wellbore 12 is shown as being cased and cemented, it can alternatively be uncased or open hole.

Even though FIG. 1 depicts a vertical well, it should be noted that embodiments of the fluid sampler apparatus 18 of the present invention can be used in deviated wells, inclined wells, or horizontal wells. As such, the use of directional terms such as above, below, upper, lower, upward, downward, and the like are used in relation to the illustrative embodiments and as they are depicted in the figures. In general, above, upper, upward, and similar terms refer to a direction toward the earth's surface along a well bore and below, lower, downward and similar terms refer to a direction away from the earth's surface along the wellbore.

As described in more detail below, the fluid sampler apparatus 18 can obtain a fluid sample from the formation at a certain position within the wellbore. The position at which a fluid sample is obtained experiences certain environment conditions, for example a certain reservoir pressure. According to some embodiments described herein, the fluid sampler apparatus can maintain the fluid sample at or near the reservoir pressure (or other condition) at which the fluid sample was obtained.

Figure 2:
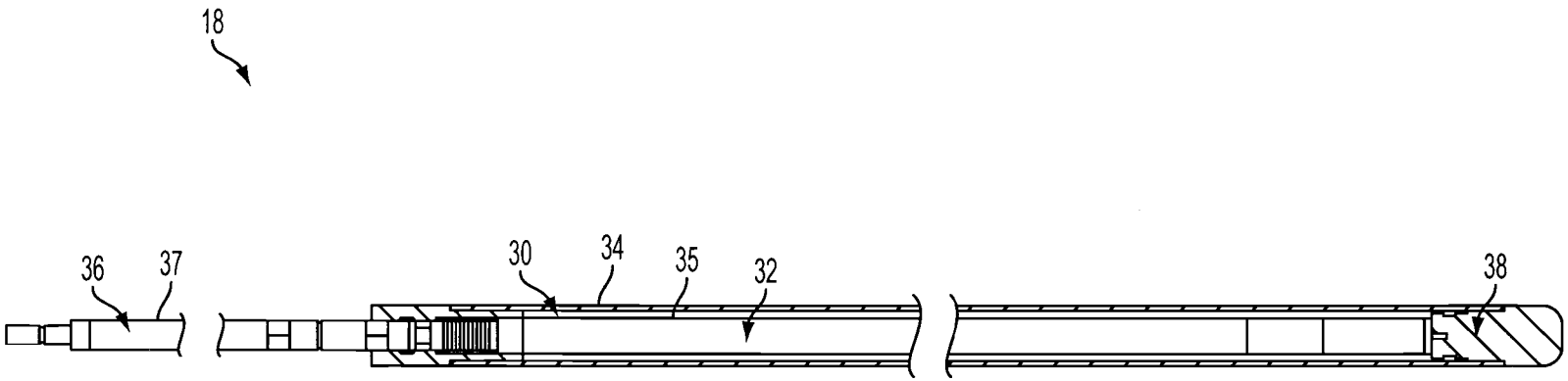
FIG. 2 is a cross-sectional view of a fluid sampler apparatus having a sampler and housing according to one embodiment of the present invention.

Referring to FIG. 2, a fluid sampler apparatus 18 having a sampler 30 and a housing 34 is shown. The housing 34 can be a high-pressure outer shell that encases at least a portion of the sampler 30. In some embodiments, the housing 34 encases the entire sampler 30. In other embodiments, the housing 34 can encase a portion of the sampler. The sampler 30 can include a sample chamber 32 and additional components, such as valves, pistons, metering devices, and other components described in more detail below in connection with FIGS. 3A-3E, to facilitate obtaining a fluid sample.

An annulus 35 is shown as the area between the sampler 32 and the housing 34. As the sampler 32 and the housing 34 are generally coaxial or concentric, the annulus 35 is defined by the area between an inner diameter of the housing 34 and an outer diameter of the sampler 32. Within the annulus 35 is a compressible fluid, for example nitrogen.

The sample chamber 32 is in fluid communication with the annulus 35. The nitrogen-filled annulus 35 can provide a pressure source to pressurize a fluid sample for the apparatus after the fluid sample is obtained. As the nitrogen is in close proximity to the sample chamber, a valve or manifold 38 can provide a channel and/or facilitate the nitrogen entering into the sampler to maintain the pressure conditions at which the fluid sample is obtained.

The housing 34 may be a sufficiently rigid material to withstand the pressures experienced in downhole conditions. In some embodiments, the housing 34 is made of steel.

The housing 34 provides a structure to protect the sampler from the environmental or reservoir conditions experienced within a wellbore. In some embodiments, the nitrogen-filled annulus 35 can provide additional support of the housing 34 as the fluid sample apparatus is conveyed downhole where higher pressure conditions are experienced.

Referring now to FIGS. 3A-3E, a fluid sampling apparatus 100 having a housing 181 encasing a sampler that embodies principles of the present invention is shown. The housing 181 spans the longitudinal length of the sampler. An annulus 182 is defined by the inner diameter of the housing 181 and the sampler casing 102. A pressure source, such as a compressible fluid, is disposed with the annulus 182. The annulus 182 can include a volume to provide a sufficient amount of compressible fluid capable of pressurizing a fluid sample received in the sampler 100. The length of the housing 181 and/or the inner diameter of the housing 181 can be modified to increase or decrease the volume of the annulus 182, as appropriate.

Figure 3A:
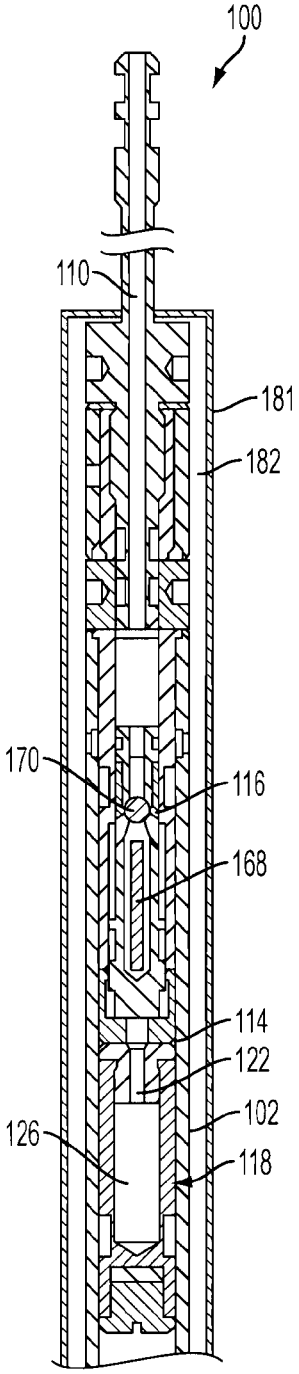
FIGS. 3A-E are cross-sectional views of successive axial portions of a fluid sampler apparatus according to one embodiment of the present invention.
Figure 3B:
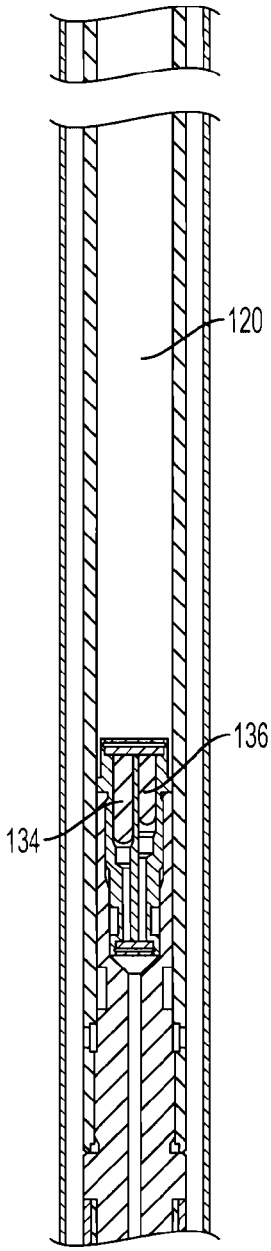
Figure 3C:
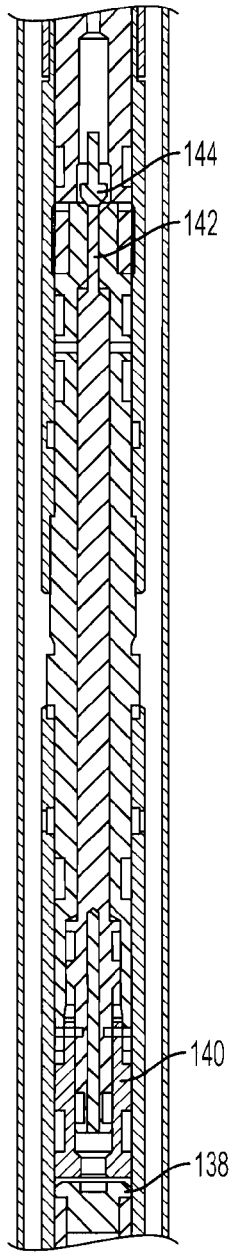
Figure 3D:
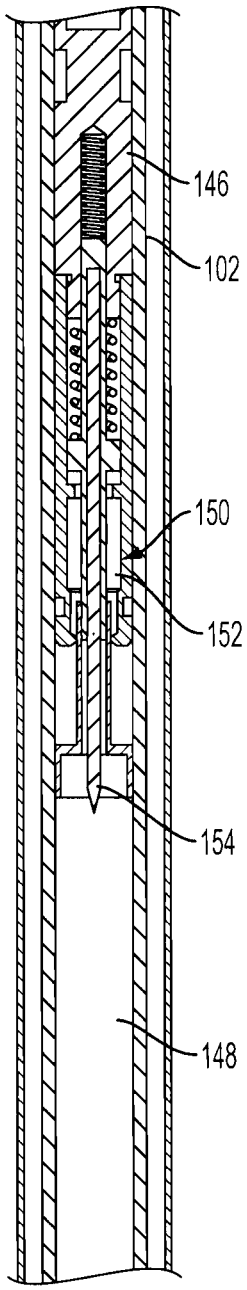
Figure 3E:
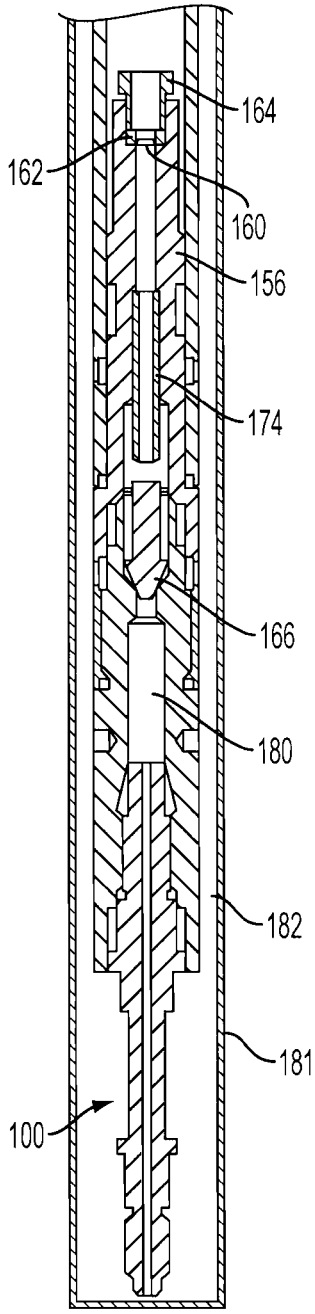

A passage 110 can be formed in an upper portion of fluid sampling apparatus 100 (see FIG. 3A). The passage 110 in the upper portion of the fluid sampling apparatus 100 can be in communication with a sample chamber 114 via a check valve 116. The check valve 116 permits fluid to flow from the passage 110 into the sample chamber 114, but prevents fluid from being released from the sample chamber 114 to the passage 110.

A debris trap piston 118 can be disposed within the sampler casing 102 and can separate the sample chamber 114 from a metering fluid chamber 120. When a fluid sample is received in the sample chamber 114, the debris trap piston 118 can be displaced downwardly relative to the sampler casing 102 to expand the sample chamber 114.

Prior to such downward displacement of the debris trap piston 118, however, fluid flows through the sample chamber 114 and a passageway 122 of the piston 118 into the debris chamber 126 of the debris trap piston 118. The fluid received in the debris chamber 126 can be prevented from flowing back into the sample chamber 114 due to the relative cross-sectional areas of the passageway 122 and the debris chamber 126, as well as the pressure maintained on the debris chamber 126 from the sample chamber 114 via the passageway 122. An optional check valve (not shown) may be disposed within the passageway 122, if desired.

In this manner, the fluid initially received into the sample chamber 114 can be trapped in the debris chamber 126. The debris chamber 126 thus permits this initially received fluid to be isolated from the fluid sample later received in the sample chamber 114. In some embodiments, the debris trap piston 118 can include a magnetic locator that can be used as a reference to determine the level of displacement of the debris trap piston 118 and thus the volume of the collected sample within the sample chamber 114 after a sample has been obtained.

A metering fluid chamber 120 initially contains a metering fluid, such as a hydraulic fluid, silicone oil, or like material. A flow restrictor 134 and a check valve 136 can control flow between the chamber 120 and an atmospheric chamber 138 that initially contains a gas at a relatively low pressure, for example, air at atmospheric pressure. A collapsible piston assembly 140 includes a prong 142 that initially maintains a check valve 144 in an "off seat" position so that flow in both directions can be permitted through the check valve 144 between the chamber 120 and the chamber 138.

In some embodiments, when elevated pressure is applied to the chamber 138, however, as described more fully below, the piston assembly 140 can collapse axially, and the prong 142 no longer maintains the check valve 144 "off seat", thereby preventing flow from the chamber 120 to the chamber 138.

A piston 146 disposed within the sampler casing 102 separates the chamber 138 from a longitudinally extending atmospheric chamber 148 that initially contains a gas at a relatively low pressure such as air at atmospheric pressure. The piston 146 can include a magnetic locator used as a reference to determine the level of displacement of the piston 146 and thus the volume within the chamber 138 after a sample has been obtained.

The piston 146 includes a piercing assembly 150 at its lower end. In the illustrated embodiment, the piercing assembly 150 is coupled to piston 146 that creates a compression connection between a piercing assembly body 152 and a needle 154. The needle 154 may be coupled to the piercing assembly body 152 via threading, welding, friction or other suitable technique. The needle 154 may have a sharp point at a lower end and may have a smooth outer surface. In other embodiments, the outer surface is fluted, channeled, knurled or otherwise irregular. In some embodiments and as discussed more fully below, the needle 154 is used to actuate the pressure delivery subsystem of the fluid sampler when the piston 146 is sufficiently displaced relative to the sampler casing 102.

Below the atmospheric chamber 148 and disposed within the longitudinal passageway of the sampler casing 102 is a valving assembly 156. The valving assembly 156 can include a pressure disk holder that receives a pressure disk therein that is depicted as rupture disk 360. In other embodiments, other types of pressure disks that provide a seal, such as a metal-to-metal seal, with pressure disk holder 158 can be used, including a pressure membrane or other piercable member. Rupture disk 160 can be held within pressure disk holder by a hold down ring 162 and a gland 164 that can be threadably coupled to the pressure disk holder. The valving assembly 156 also includes a check valve 166. The valving assembly 156 initially prevents fluid communication between chamber 148 and a passage 180 in a lower portion of sampling chamber 100. After actuation of the pressure delivery subsystem by the needle 154, the check valve 166 permits fluid flow from the passage 180 to the chamber 148, but prevents fluid flow from the chamber 148 to the passage 180.

Passage 180 in the lower portion of sampling chamber 100 can be configured in sealed communication with the annulus 182 that includes the pressure source. The compressible fluid stored within the annulus 182 can flow from the passage 180 to the chamber 148, thus pressurizing the sample.

As described above, once the fluid sampler is in its operable configuration and is located at the desired position within the wellbore, a fluid sample can be obtained into the sample chamber 114 by a trigger device of an operating actuator. Fluid from a passage can then enter the passage 110 in the upper portion of the sampling chamber 100. The fluid flows from the passage 110 through the check valve 116 to the sample chamber 114. In some embodiments, the check valve 116 includes a restrictor pin 168 to prevent excessive travel of a ball member 170.

An initial volume of the fluid can be trapped in the debris chamber 126 of piston 118 as described above. Downward displacement of the piston 118 can be slowed by the metering fluid in the chamber 120 flowing through the restrictor 134. This can prevent pressure in the fluid sample received in the sample chamber 114 from dropping below its bubble point.

As the piston 118 displaces downward, the metering fluid in the chamber 120 can flow through the restrictor 134 into the chamber 138. At this point, the prong 142 can maintain the check valve 144 in an "off seat" position. The metering fluid received in the chamber 138 can cause the piston 146 to displace downwardly. When the needle 154 pierces the rupture disk 160, the valving assembly 156 is actuated. Actuation of the valving assembly 156 permits pressure from the pressure source stored within the annulus 182 to be applied to the chamber 148. Once the rupture disk 160 is pierced, the pressure from the pressure source within the annulus 182 passes through the valving assembly 156, including moving the check valve 166 "off seat". In the illustrated embodiment, a restrictor pin 174 prevents excessive travel of the check valve 166. Pressurization of the chamber 148 also results in pressure being applied to the chamber 138, and chamber 120 and thus to sample chamber 114.

The check valve 144 then prevents pressure from escaping from the chamber 120 and the sample chamber 114. The check valve 116 also prevents escape of pressure from sample chamber 114. In this manner, the fluid sample received in the sample chamber 114 is pressurized.

Fluid sampler apparatuses, such as those shown in the Figures, can be useful for providing a sampler that can be conveyed via a slickline, wireline, or coiled tubing, rather than many conventional samplers that are pipe conveyed. The apparatuses and devices described herein include a presence of a high-pressure source within the construction of the apparatus or device.

In the apparatuses and devices described herein, the pressure source is self-contained within each sampler, rather than a common pressure source as found in conventional sampling devices. In slickline, wireline, or coiled tubing applications, a large, common pressure source casing is not applicable.

The foregoing description of the embodiments, including illustrated embodiments, of the invention has been presented for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An apparatus for obtaining a fluid sample in a subterranean well, the apparatus comprising:

a sampler having a sample chamber configured for being selectively in fluid communication with an exterior of the sampler and operable to receive at least a portion of a fluid sample;

a housing disposed exterior to the sampler, the housing defining an annulus between at least part of the housing and at least part of the sampler, wherein the annulus comprises a compressible fluid.

2. The apparatus of claim 1, wherein the apparatus is capable of being disposed in the subterranean well using at least one of a slickline, wireline, or coiled tubing.

3. The apparatus of claim 1, wherein the compressible fluid comprises nitrogen.

4. The apparatus of claim 1, wherein the annulus is selectively in fluid communication with the sample chamber such that the compressible fluid is operable to pressurize the fluid sample received in the sample chamber.

5. The apparatus of claim 1, further comprising a manifold configured to provide the fluid communication between the sampling chamber and the annulus.

6. The apparatus of claim 1, wherein the housing encases at least a portion of the sampler.

7. The apparatus of claim 1, wherein the annulus comprises a volume sufficient to contain a volume of the compressible fluid to pressurize the fluid sample received in the sample chamber.

8. The apparatus of claim 1, wherein the housing extends longitudinally along the length of the sampler.

9. The apparatus of claim 1, wherein the housing is generally coaxial with the sampler.

10. The apparatus of claim 1, wherein the compressible fluid has a greater compressibility than hydraulic fluid.

11. A method for obtaining a fluid sample in a subterranean well, the method comprising:

positioning a fluid sampler in the well by at least one of a slickline, wireline, or coiled tubing;

obtaining a fluid sample in a sample chamber of the fluid sampler; and pressurizing the fluid sample using a pressure source disposed in an annulus defined by a housing encasing the fluid sampler, the pressure source being in fluid communication with the sample chamber and including a compressible fluid in the annulus.

12. The method of claim 11, wherein the annulus is defined by an inner diameter of the housing and an outer diameter of the sampler.

13. The method of claim 11, wherein the annulus extends longitudinally along the length of the sampler.

14. The method of claim 11, wherein the compressible fluid comprises nitrogen.

15. The method of claim 11, further comprising retrieving the fluid sampler to the surface.

16. The method of claim 11, wherein positioning the fluid sampler in the well by at least one of the slickline, wireline, or coiled tubing includes positioning the fluid sampler in the well by wireline.

17. The method of claim 11, further comprising running from a surface of the well the fluid sampler including the pressure source including the compressible fluid that is released into the annulus encasing the fluid sampler in the well.

18. A system capable of being disposed with at least one of a slickline, wireline, or coiled tubing for obtaining a fluid sample in a subterranean well, the system comprising:

a sampler for receiving a sample of hydrocarbon fluid in a sample chamber, the sampler having an outer diameter;

a housing disposed exterior to the outer diameter of the sampler, the housing having an inner diameter; and a pressure source comprising a compressible fluid, the pressure source disposed within an annulus defined by the outer diameter of the sampler and the inner diameter of the housing such that the compressible fluid is releasable in the annulus, wherein the housing is configured for providing a pressure seal between the annulus and an environment exterior to the housing, and wherein the sampler is configured for being selectively in fluid communication with the pressure source such that the compressible fluid is operable to pressurize the sample of hydrocarbon fluid.

19. The system of claim 18, wherein the sampler comprises a valving assembly configured to permit pressure from the pressure source to be applied to the sampler.

20. The system of claim 18, further comprising a trigger configured for causing the sampler to obtain the hydrocarbon fluid.

* * * * *